US005451931A

United States Patent [19]

Müller et al.

[11] Patent Number: 5,451,931

[45] Date of Patent: Sep. 19, 1995

[54] OPTICAL SMOKE DETECTOR

[75] Inventors: Kurt Müller; Peter Ryser, both of Stäfa; Dieter Wieser, Zürich; Rino E. Kunz, Steinmaur; Markus Rossi, Ebnat-Kappel; Michael T. Gale, Wettswil, all of Switzerland

[73] Assignee: Cerberus AG, Maennedorf, Switzerland

[21] Appl. No.: 120,947

[22] Filed: Sep. 14, 1993

[30] Foreign Application Priority Data

Sep. 14, 1992 [CH] Switzerland ..... 2884/92

[51] Int. Cl.[6] ..... G08B 17/00

[52] U.S. Cl. ..... 340/630; 340/628; 250/573; 250/574; 356/338; 356/342; 356/347

[58] Field of Search ..... 250/503.1, 573, 574; 340/628, 630; 356/327, 338, 340, 342, 347

[56] References Cited

U.S. PATENT DOCUMENTS

| | | | |
|---|---|---|---|
| 4,175,865 | 11/1979 | Horvath et al. | 356/338 |
| 4,230,950 | 10/1980 | Forss et al. | 250/574 |
| 4,242,673 | 12/1980 | Cooper | 340/630 |
| 4,397,557 | 8/1983 | Herwig et al. | 356/342 |
| 4,857,895 | 8/1989 | Kaprelian | 340/630 |
| 4,936,666 | 6/1990 | Futhey | 350/452 |
| 4,966,446 | 10/1990 | Huang et al. | 350/417 |
| 5,130,531 | 7/1992 | Ito et al. | 250/216 |

FOREIGN PATENT DOCUMENTS

| | | |
|---|---|---|
| 0031096 | 7/1981 | European Pat. Off. . |
| 0462642 | 12/1991 | European Pat. Off. . |
| 2822547 | 12/1978 | Germany . |
| 3743737 | 7/1988 | Germany . |
| 3831654 | 3/1990 | Germany . |
| 54-13391 | 1/1979 | Japan . |
| 2236390 | 4/1991 | United Kingdom . |
| 8909392 | 10/1989 | WIPO . |

*Primary Examiner*—Jeffery A. Hofsass
*Assistant Examiner*—Julie Lieu
*Attorney, Agent, or Firm*—Brumbaugh, Graves, Donohue & Raymond

[57] ABSTRACT

Optical smoke detectors such as extinction smoke detectors and scattered-light smoke detectors include a radiation source, a radiation detector or receiver, and a measurement volume which is in communication with ambient atmosphere and which is traversed by a light path from the radiation source to the radiation receiver. For compactness and simplicity, such an optical smoke detector is provided with a planar-optical element in the optical path. Suitable as planar-optical elements are diffractive elements, e.g., holographic-optical elements (HOE), and micro-Fresnel elements (MFE), e.g., micro-Fresnel reflectors (MFR).

30 Claims, 5 Drawing Sheets

OPTICAL SMOKE DETECTOR

BACKGROUND OF THE INVENTION

The invention relates to optical smoke detectors, especially for use as early-warning automatic fire detectors.

Among the many types of commercially available automatic fire detectors, smoke detectors are particularly suitable as early-warning detectors, for timely fire-fighting intervention.

In the main, smoke detectors may be classified as ionization smoke detectors or optical smoke detectors. Response of the former is based on adsorption of atmospheric molecules on smoke particles; in the latter, optical properties of aerosols are used for smoke detection. This may involve sensing of attenuation or extinction of an optical beam by smoke ("extinction detector"), or sensing of optical scattering at smoke particles ("scattered-light detectors"). Since extinction by smoke is a relatively weak effect, a measurement distance has to be relatively long for positive smoke detection, or costly design and/or electronic measures are required for positive fire detection. In scattered-light detectors, the measurement distance can be relatively short, and these are most prevalent as so-called point detectors.

In German Patent Document DE-A1-2,822,547 (Hochiki Corp.; Dec. 7, 1978), a line extinction detector is described which includes a light source. After traversing a measurement distance, a portion of light emitted by the light source reaches a radiation receiver. If smoke is present in the measurement distance, the output signal of the radiation receiver will be reduced as a function of smoke density. This output signal is fed to a threshold-and-comparison circuit followed by an evaluation circuit for triggering an alarm signal if the output signal falls below a predetermined alarm-threshold value. Lenses are disposed in front of the radiation source and of the radiation receiver, for focusing of the light traversing the measurement path. The focusing systems are very costly.

Most of the older scattered-light smoke detectors are based on forward-scattered light, with large smoke aerosol particles having a strong effect, and with small smoke particles causing little light scattering. Smoke detectors based on back scattering have more uniform sensitivity and are more universally suitable. However, due to lower intensity of back-scattered light, more elaborate electronic circuitry is required. Moreover, as scattered light is likely to be reflected from the walls of a housing into the receiver, a complicated optical labyrinth or radiation trap is required (e.g., a plurality of diaphragms as disclosed in European Patent Document EP-A1-0,031,096) to keep internally reflected light from the radiation receiver.

In combination with optical focusing lenses in front of the light source and the receiver, the diaphragms in the measurement chamber of the smoke detector according to EP-A1-0,031,096 further serve for focusing of the light beam directed to the measurement volume, and of the radiation scattered from the measurement volume, for shortening of the smoke detector.

Size reduction is desirable not only for aesthetic reasons, but also for the sake of simplified mass production of smoke detectors. Accordingly, German Patent Document DE-A1-3,743,737 (Hochiki Corp.; Jul. 7, 1988) discloses a smoke detector shaped especially for compactness. However, economical mass production is impeded in that a separate, possibly manual assembly step is required to provide a circuit board with a wired photodiode.

Parasitic scattered light, e.g., as caused by contamination, can reach the optical receiver from the measurement chamber. German Patent Document DE-A1-3,831,654 (Beyersdorf; Mar. 22, 1990) discloses detection of contamination of the measurement chamber by means of a second photodiode, for preventing an alarm if contamination exceeds a predetermined value.

For size reduction, and to reduce the number of components, British Patent Document GB-A1-2,236,390 (Matsushita; Apr. 3, 1991) discloses a scattered-light smoke detector which includes a wired IRED radiation source in an integrated circuit on a printed-circuit board, and a radiation-receiver photodiode lying flat on the board. A prism with integrated lens serves as deflection and focusing element for concentrating the scattered radiation from the measurement chamber onto the photodiode. This prism with integrated lens is relatively costly; moreover, the required precise placement of the lens is quite complicated.

In European Patent Document EP-A1-0,462,642 (Ajax de Boer; Dec. 27, 1991), scattered-light smoke detectors are disclosed in which the polarization of scattered light is used for detecting smoke concentration, particle size and, up to a point, particle shape. These smoke detectors have more uniform response to different types of fire.

Optical smoke detectors using electronic components, for producing signals to an evaluation circuit for determining the presence of smoke are further shown and described, e.g., in U.S. Pat. No. 4,119,949, issued Oct. 10, 1978 to E. G. Lindgren and in U.S. Pat. No. 4,857,895, issued Aug. 15, 1989 to E. K. Kaprelian.

The cited patent documents include no teaching concerning a more compact design or simplified construction of optical smoke detectors.

SUMMARY OF THE INVENTION

For compactness and simplicity, an optical smoke detector is provided with a planar-optical element in an optical path from a radiation source to a radiation receiver. Among suitable planar-optical elements are diffractive elements, e.g., holographic-optical elements (HOE), and micro-Fresnel elements (MFE), e.g., micro-Fresnel reflectors (MFR). The optical smoke detector may be an extinction smoke detector or a scattered-light smoke detector.

BRIEF DESCRIPTION OF THE DRAWING

The figures show preferred embodiments of the invention and parts thereof.

DETAILED DESCRIPTION OF PREFERRED EMBODIMENTS

Figure 1:
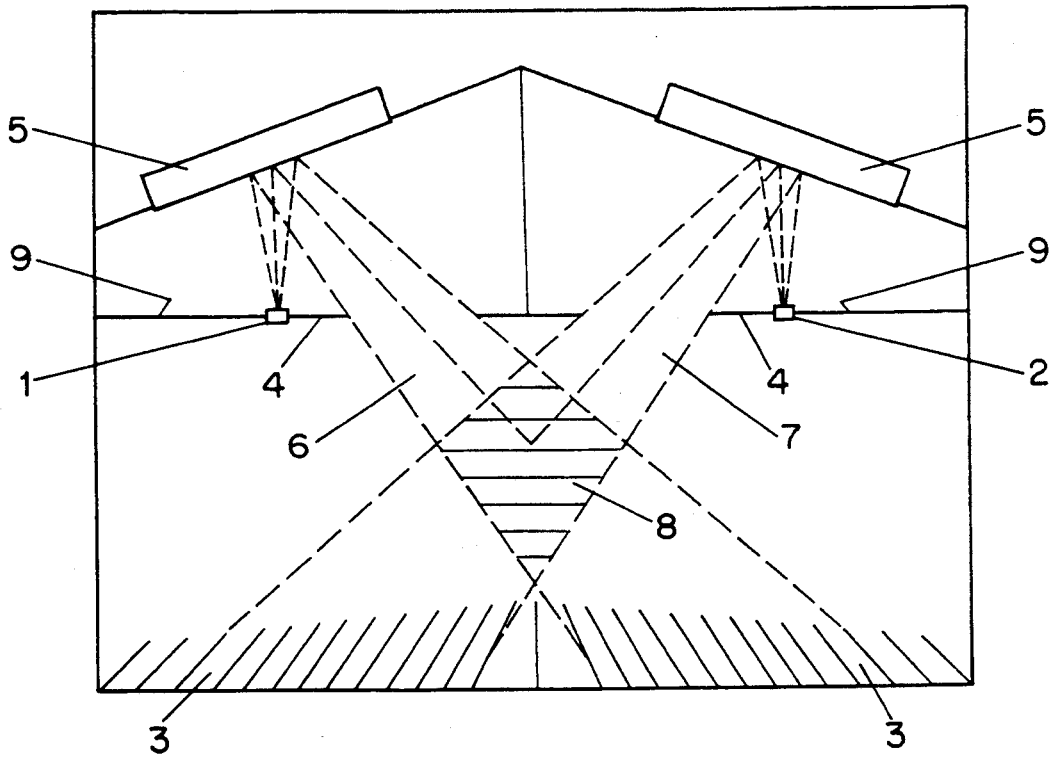
FIG. 1 is a vertical section of a scattered-light smoke detector with two planar-optical elements (POE)

FIG. 1 shows an optical smoke detector based on scattered-light detection, including two planar-optical elements (POE). By surface-mount technology, an infrared-emitting diode 1 (SMD-IRED) and a photodiode 2 (SMD-photodiode) are mounted on a printed-circuit board 9. Respective planar-optical elements (POE) 5 are disposed above the radiation source (SMD-IRED) 1 and above the radiation receiver (SMD-photodiode) 2, for deflecting the emitted light and the light scattered at aerosol particles, respectively. This involves two deflecting and focusing optical elements, e.g., two holographic-optical elements (HOE) 5 or two micro-Fresnel elements (MFE) 5.

Micro-Fresnel elements (MFE) are diffractive Fresnel lens structures on a microscopic scale, as disclosed as transmissive elements, e.g., in U.S. Pat. No. 4,936,666 (3M-Company; Jun. 26, 1990). The manufacture of such micro-Fresnel lenses for transmission and reflection in an on-axis configuration is described, e.g., by T. Shiono et al., Optics Letters, Vol. 15, No. 1, p. 84 (Jan. 1, 1990). Phase-matched micro-Fresnel reflectors as used in accordance with the invention are planar arrangements of inclined and curved microsurfaces consisting of ellipsoidal portions. For use as surface mirrors, they are coated with a reflective layer. The microsurfaces are phase matched, i.e., the optical path from one focus to the other across each one of the microsurfaces differs in length by an integral multiple of the optical wavelength.

With currently available holographic-optical elements (HOE) and micro-Fresnel elements (MFE), refractive optical elements may be realized with a degree of efficiency which is far below 100 percent. As a result, the surface of the refractive optical element acts as a source of diffuse scattered light, so that a considerable portion of the radiation emitted by radiation source 1 may flood the measurement chamber 8 as diffuse radiation. This radiation can amount to several times the light which is scattered at smoke aerosol particles. Mechanical diaphragms can be used to reduce the influence of the former.

Figure 2:
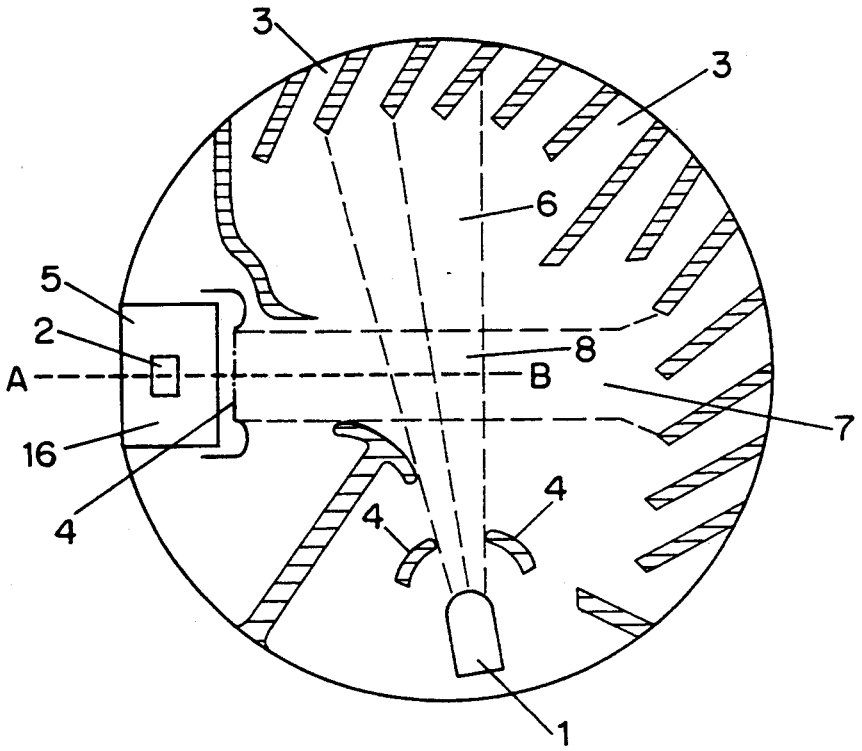
FIG. 2 is a horizontal section of a scattered-light smoke detector with a radiation source without optical element, and with a photodiode with a planar-optical element as deflection element.
Figure 3:
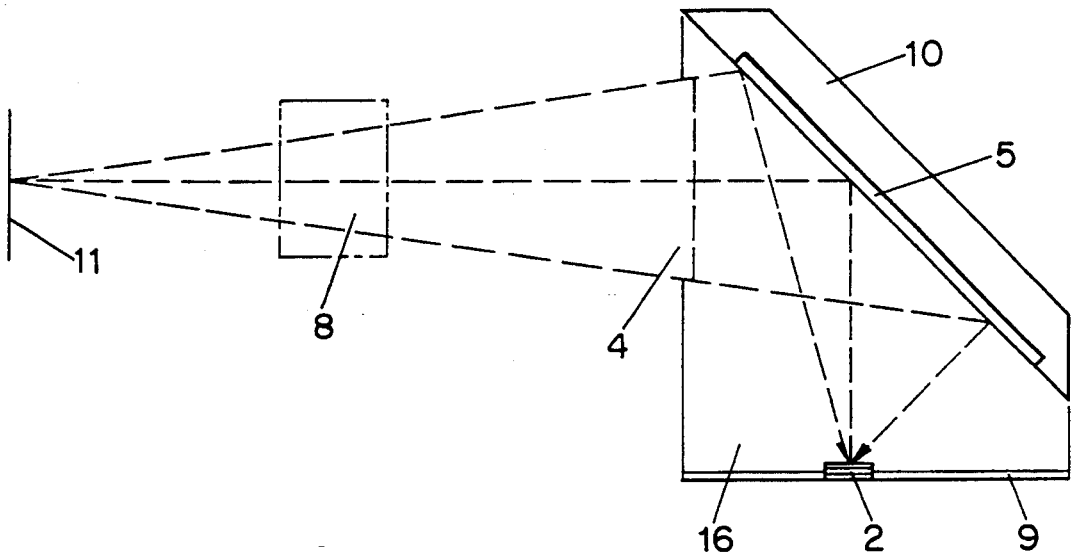
FIG. 3 is a vertical section of the scattered-light detector of FIG. 2 along the line A–B (photodiode compartment and measurement volume)

Further in this respect, FIGS. 2 and 3 show an improved scattered-light smoke detector, including a wired infrared-emitting diode 1 without optical element and a photodiode 2 on the printed-circuit board 9, and with a holographic-optical element (HOE) 5 or a phase matched micro-Fresnel reflector (PMFR) 5 as deflecting element. The photodiode 2 serves as a radiation receiver and is disposed in a blackened compartment 16 which communicates with the interior of the detector only via a diaphragm 4. Thus, diffuse scattered light is substantially excluded from the surface of the planar-optical element (HOE or PMFR).

In accordance with a particularly preferred embodiment, see FIG. 3, the opening in diaphragm 4 is covered with a radiation-permeable foil or a polarization filter, to prevent dust from reaching the radiation receiver. In the case of scattered-light detectors, a scattering angle of 70°–110° is customary. In such detectors, by inclusion of a polarization filter having a plane of polarization perpendicular to the scattering plane, detector sensitivity can be equalized for open fires which produce aerosols with small particles, and for smolder fires which produce (smoke) aerosols with large particles.

In a further preferred scattered-light smoke detector, two closely spaced, different-color light sources are used, e.g., red and infrared. Two radiation receivers (photodiodes) are included at locations where the radiation is focused by the phase-matched micro-Fresnel reflector. (PMFR). Due to achromatism of the phase-matched micro-Fresnel reflector (PMFR), there is less concern with chromatic aberration due to the relatively broad spectral distribution of IRED- and LED-radiation.

Figure 4:
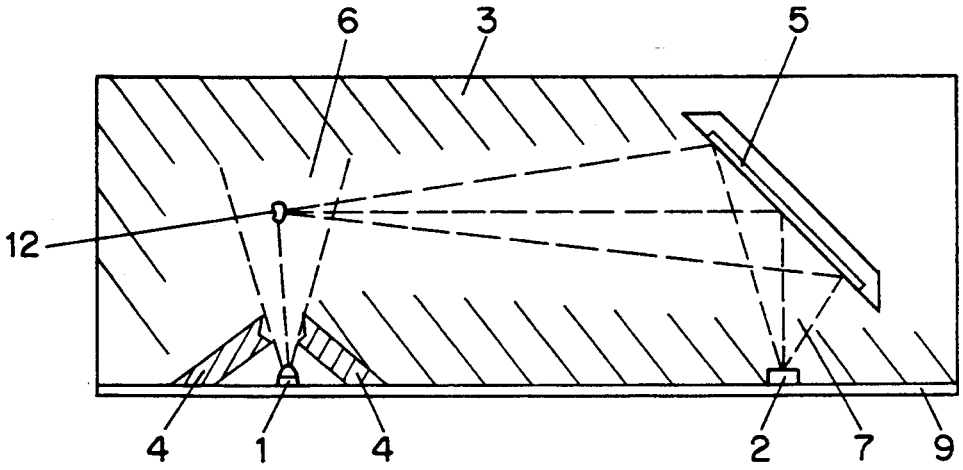
FIG. 4 is a vertical section of a scattered-light smoke detector with radiation source on a printed-circuit board and with a planar-optical element above the radiation receiver.

A preferred further embodiment of a scattered-light smoke detector in accordance with the invention is shown in FIG. 4, without a planar-optical element (POE) above the radiation source 1. The radiation source 1, namely an infrared-emitting diode (IRED), is mounted on the printed-circuit board 9. The radiation beam 6 from the radiation source 1 is kept narrow by diaphragms 4, and radiation not scattered from smoke particles 12 in the direction of the planar-optical element 5 above the radiation receiver 2 disappears into the light trap 3.

Figure 5:
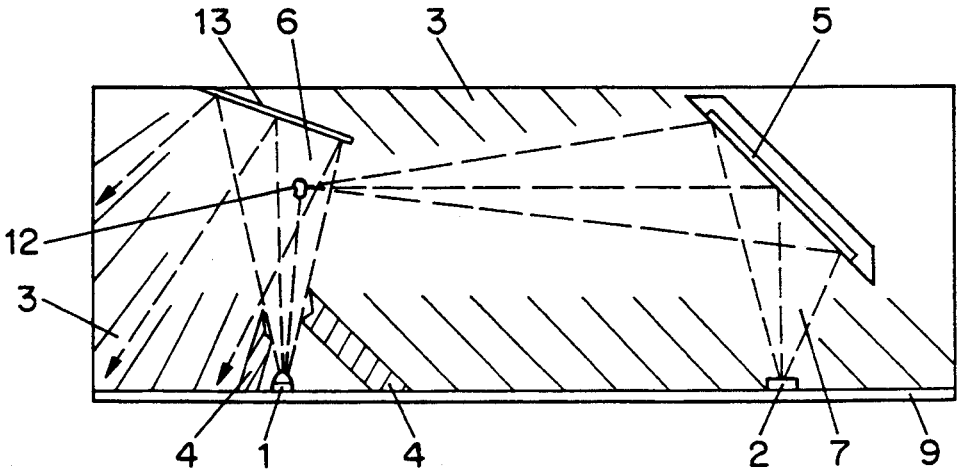
FIG. 5 is a vertical section of a scattered-light smoke detector with a mirror.

FIG. 5 shows a further variant of the scattered-light smoke detector of FIG. 4, a planar or curved second mirror 13 being disposed above the radiation source 1. The mirror 13 laterally deflects light not scattered from smoke particles 12 in the direction of the radiation receiver 2. The deflected light falls into a light trap 3 where it is absorbed. Thus, the light trap 3 can be placed where there is sufficient space for design efficacy.

Figure 6:
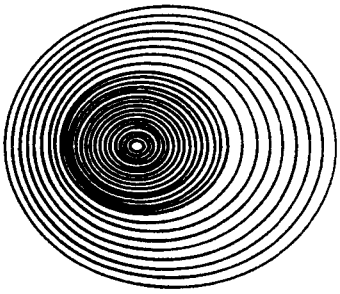
FIG. 6 is a top view of a phase-matched micro-Fresnel reflector (PMFR)
Figure 7:
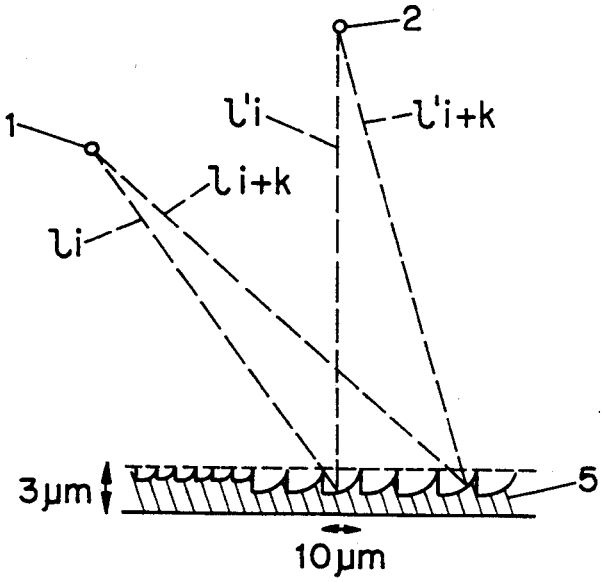
FIG. 7 is a cross section of a phase-matched micro-Fresnel reflector (PMFR) according to FIG. 6, in which the microstructure is on the front of a substrate.
Figure 8:
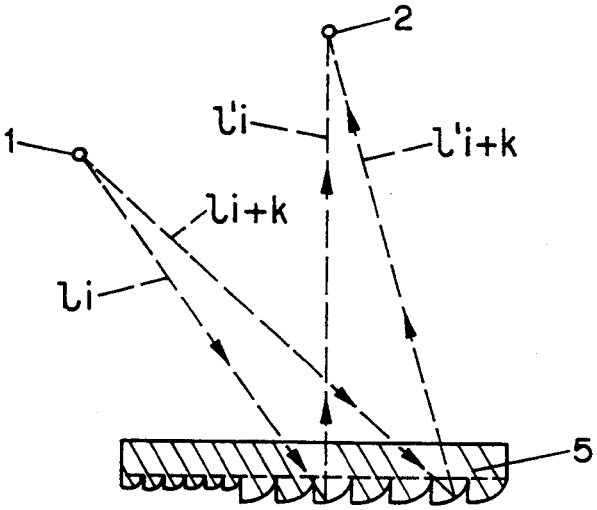
FIG. 8 is a cross section of a phase-matched micro-Fresnel reflector (PMFR) according to FIG. 6, in which the microstructure is on the back of a substrate.

FIG. 6 shows structural detail of a phase-matched micro-Fresnel reflector (PMFR) suitable for a scattered-light smoke detector in accordance with the invention, viewed from above. FIGS. 7 and 8 show sections of the phase-matched micro-Fresnel reflector (PMFR). The PMFR are called phase-matched because the optical paths $li+l'i$ and $li+k+l'i+k$ from the radiation source 1 to the radiation receiver 2 via each of the ellipsoidal microsurfaces differ by an integral multiple of the optical wavelength.

The structure may be on the front or the rear side of a substrate. The latter variant is less sensitive to dust and corrosion, as the mirrored structure can be provided with a protective coating. The manufacture of the phase-matched micro-Fresnel reflector (PMFR) may involve laser writing in a photoresist. A nickel coining stamp is produced therefrom and reproduced. By coining in plastic substrates, e.g., polymethylmethacrylate (PMMA), polyvinylchloride (PVC) or polycarbonate (PC), the phase-matched micro-Fresnel reflectors (PMFR) can be produced inexpensively and in large quantities. A planar-optical element may be laminated to a radiation trap, or embossed thereon, e.g., as a radiation trap is made by injection molding.

Phase-matched micro-Fresnel reflectors (PMFR) may be optimized for a wavelength of 880 nm (infrared). Across the active surface, e.g., measuring 17 mm by 12 mm, depth of profile varies to 3 μm; see FIGS. 7 and 8. The phase-matched micro-Fresnel reflectors (PMFR) lie in the transition zone between diffractive and purely reflective or refractive elements. At the microsurfaces there is reflection or transmission, and at the transition edges between the microsurfaces there is diffraction with equi-phase superposition of the refracted light portion at the second focus. Advantageously, as mentioned, the phase-matched micro-Fresnel reflectors (PMFR) are less sensitive to chromatic aberration than the holographic-optical elements (HOE).

Figure 9:
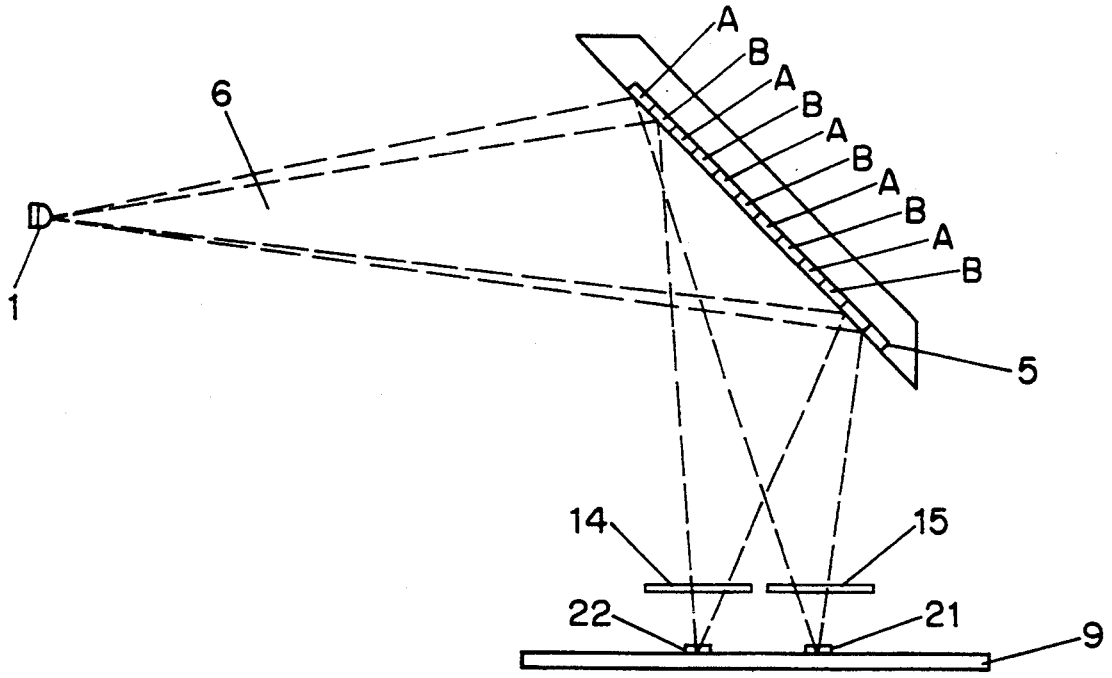
FIG. 9 is a vertical section of an optical smoke detector with a planar-optical element for concentrating the radiation onto two radiation receivers, and with polarizers having different polarization planes in each radiation path.

FIG. 9 shows a further preferred embodiment of a scattered-light detector in accordance with the invention. This scattered-light detector includes a planar-optical element (POE) having a structure with (concentric) regions A, B, . . . which are so disposed and formed that light from the radiation source 1 falls onto two different radiation receivers 21, 22. For example, by the concentric Zone A the radiation is deflected onto the photodiode 21, and by the concentric zone B to the photodiode 22. The surface ratio of the sum of the zones A and the sum of the zones B can be chosen freely.

Polarization filters 14 and 15 may be disposed above the radiation receivers 21, 22, preferably with mutually perpendicular planes of polarization, so that detection of scattered light can be based on polarization. The above-mentioned advantages accrue, namely of equalization of sensitivity of detectors for the detection of open fires and of smolder fires. With prior optical systems, two elements would be required for this purpose, imaging two different regions (with different background radiation) of the measurement volume. By contrast, a planar-optical element (POE) as used here images one and the same measurement volume. By inclusion of two radiation sources, four foci can be obtained, so that scattered light can be analyzed according to color and polarization.

Figure 11:
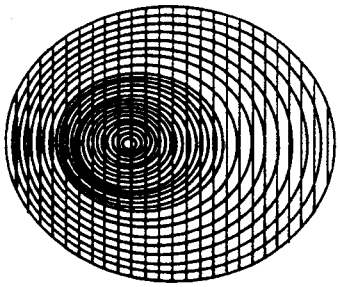
FIG. 11 is a top view of a phase-matched micro-Fresnel reflector (PMFR), embossed with a linear grating.

Separation of scattered light which is deflected by the planar-optical element onto several radiation receivers may be effected by means of a planar-optical element as shown in FIG. 11. Here, light is deflected by means of a phase-matched micro-Fresnel reflector (PMFR), as shown in FIG. 6, and the scattered radiation is separated onto the different radiation receivers upon refraction at a linear grating which is superposed on the phase-matched micro-Fresnel reflector (PMFR), the grating structure being adapted to the principal wavelength of the radiation source.

Depending on the structure of the superposed grating, one, two or several refractive orders (and thus foci) can be realized. Also, within the different refractive orders, the energy distribution can be chosen by suitable choice of the grating structure, e.g., a sine grating has the refractive orders $-1, 0 +1$, with the energy of the orders $-1$ and/or $+1$ being raised upon suitable choice of the depth of the structure, or by suitable "blazing". By contrast, a rectangular grating has a large number of orders. Further still, for a freely selected number of foci and a freely selected energy distribution at the foci, a grating structure of suitable shape can be determined.

Figure 10:
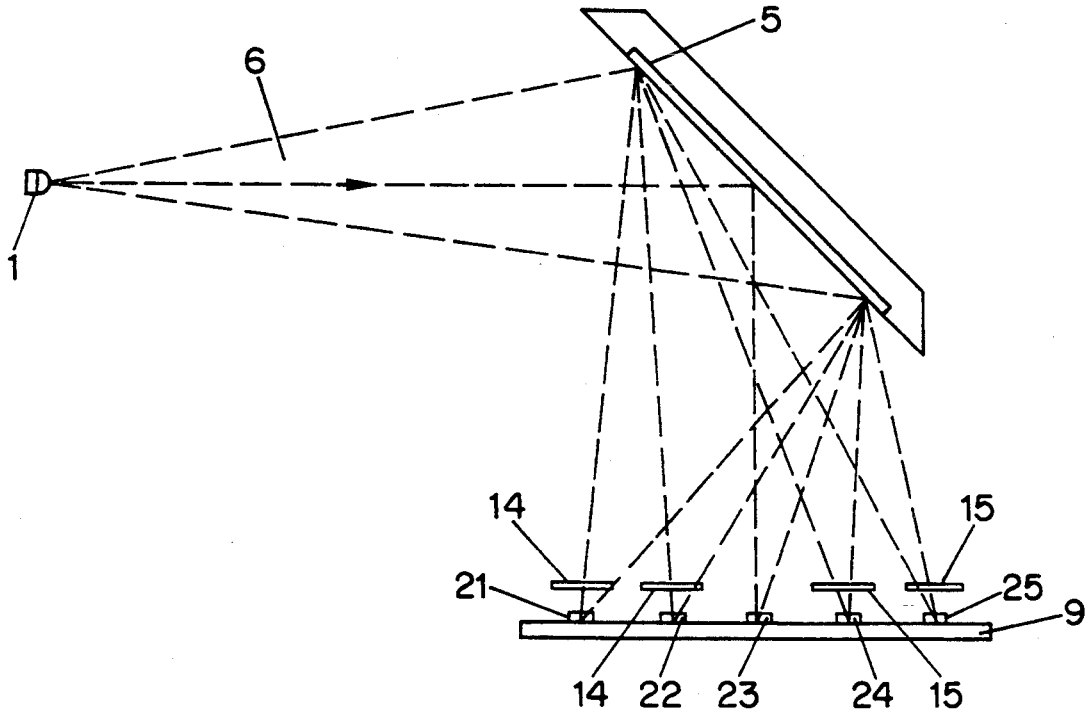
FIG. 10 is a vertical section of an optical smoke detector with a planar-optical element and a superposed grating for concentrating the radiation onto several radiation receivers, and with polarizers having different planes of polarization in each radiation path.

FIG. 10 shows an embodiment of an optical smoke detector in accordance with the invention in which a planar-optical element (POE) is used as deflection mirror 5. In FIG. 11, the planar-optical element (POE) is shown. Scattered light is deflected by elliptically disposed, phase-matched microsurfaces which alternately belong to ellipsoids with different foci. Separation of the scattered radiation onto the different radiation receivers 21, 22, 23, 24, 25 is by refraction at a linear grating which is superposed on the phase-matched micro-Fresnel reflector (PMFR), the grating structure being adapted to the principal wavelength of the radiation source.

The radiation source 1 consists of a near-infrared-emitting diode (IRED) and a red-emitting diode (LED) in a common housing. The linear grating of the mirror 5 is chosen such that the radiation is deflected onto five different foci at which respective radiation receivers 21, 22, 23, 24, 25 are disposed. In accordance with a preferred embodiment, polarization filters 14 with parallel planes of polarization are disposed in front of the two radiation receivers 21, 22. In front of two other radiation receivers 24, 25, there are polarization filters 15 whose planes of polarization are perpendicular to the planes of polarization of the polarization filters 14. One of the radiation receivers 23 is without a polarization filter, so that this radiation receiver 23 receives light of all wavelengths and polarizations.

The following radiation may be incident on the radiation receivers: first radiation receiver 21: infrared light polarized perpendicular (to the scattering plane); second radiation receiver 22: red light, polarized perpendicular; third radiation receiver 23: infrared light and red light, unpolarized; fourth radiation receiver 24: red light polarized parallel; fifth radiation receiver 25: infrared light polarized parallel. Thus, with suitable electronic circuitry, it will be possible to determine whether light scattered in the measurement volume 8 originates with large or with small smoke particles. Thus also, more uniform response of the smoke detectors can be realized as a function of different fires (open fire with small smoke particles or smolder fire with large particles).

Figure 12:
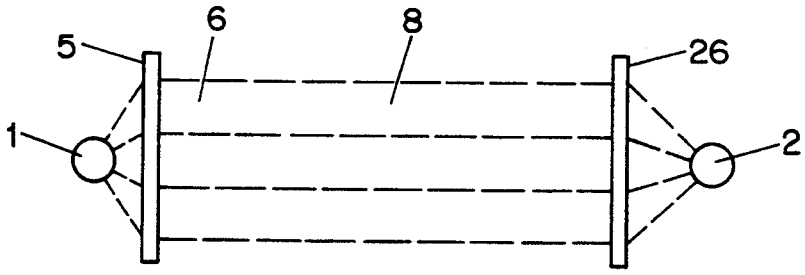
FIG. 12 is a cross section of an extinction smoke detector with transmissive planar-optical elements.
Figure 13:
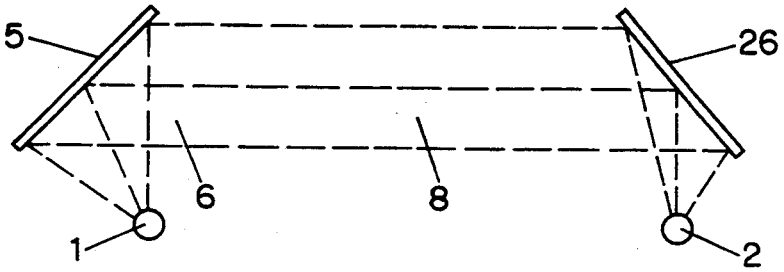
FIG. 13 is a cross section of an extinction smoke detector with reflective planar-optical elements.

FIG. 12 shows a cross section of an extinction smoke detector in accordance with a preferred embodiment of the invention. A planar-optical element (POE) 5 is disposed in front of the radiation source 1, for collimating the radiation of the radiation source 1 into an approximately parallel radiation beam 6. A second planar-optical element 26 is disposed in front of a radiation receiver 2, for focusing onto the radiation receiver 2 the radiation after passage through the measurement volume 8. Instead of transmissive planar-optical elements 5, 26, reflective planar-optical elements can be used as shown in FIG. 13, e.g., at an angle of 45° to the radiation in the measurement volume 8.

Figure 14:
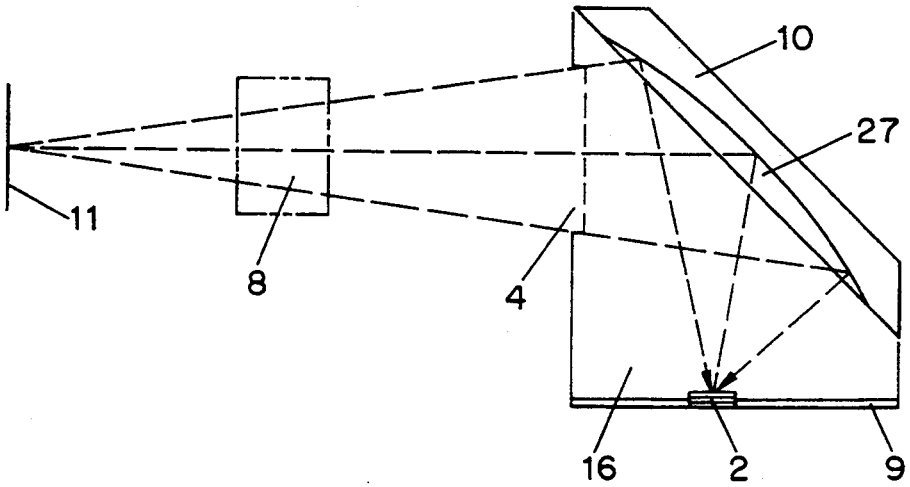
FIG. 14 is a vertical section of a scattered-light smoke detector with ellipsoidal mirror.

FIG. 14 shows a further embodiment of a scattered-light smoke detector in accordance with the invention, with a wired infrared-emitting diode 1 without an optical element, with a photodiode 2 on the printed-circuit board 9, and with an ellipsoidal mirror 27 as deflection element. The photodiode 2 which serves as radiation receiver is disposed in a blackened compartment 16 which communicates with the interior of the detector only via a diaphragm 4.

For inexpensive mass production, improved smoke detectors are compact and have few components. Fabrication tolerances are less stringent, so that manual adjustment is minimized or eliminated. The following are among further advantages and benefits which arise with preferred embodiments of the invention:

Use of planar-optical elements (POE), such as holographic-optical elements (HOE), micro-Fresnel elements (MFE), e.g., micro-Fresnel reflectors (MFR) and phase-matched micro-Fresnel reflectors (PMFR) enhances design flexibility and permits detection of different types of fire through evaluation of the polarization of scattered light.

Detectors can be made with fewer components and with electronic circuitry having flat-lying components, and with a surface-mounted photodiode, SMD photodiode, or an integrated circuit (IC) with integrated photodiode, at low cost, with automatically mountable elements.

Since light emitted by the light source and light scattered by the smoke particles can be directed substantially parallel to the ceiling, the detector can be made very flat. This is realized upon use of planar-optical elements (POE) as focusing optical deflection elements, e.g., holographic-optical elements (HOE) and micro-Fresnel elements (MFE) such as micro-Fresnel reflectors (MFR) and phase matched micro-Fresnel reflectors (PMFR).

In extinction smoke detectors, the use of planar-optical elements (POE) as focusing optical elements, e.g., holographic-optical elements (HOE) and micro-Fresnel elements (MFE) such as micro-Fresnel reflectors (MFR) and phase-matched micro-Fresnel reflectors (PMFR) permits simplified manufacture and inexpensive mass production.

Particularly advantageous are microstructures which can be made e.g., by coherent superposition of two waves, e.g., having a wavelength of 441.6 nm (HeCd-laser), in a photoresist, or with the aid of a computer as micro-relief. They can be produced inexpensively., e.g., by replication in plastic. The micro-relief is coated with a reflective layer, e.g., of gold or nickel. At this time, still, holographic-optical elements (HOE) have relatively small refractive efficacy. By coining in plastic substrates, holographic elements (HOE) can be mass produced inexpensively.

Use of micro-Fresnel elements (MFE) results in minimized chromatic aberration. Micro-Fresnel elements (MFE) as well as holographic-optical elements (HOE) are planar-optical elements and can be produced and positioned with high accuracy. Both are of simple design and can be made inexpensively.

A photodiode and the electronic control circuitry of an infrared-emitting diode (IRED) can be integrated into the integrated circuit (IC) of receiver electronic circuitry. There remain only few circuit elements, e.g., charging capacitor, voltage stabilization, and protective elements for signalling lines, which cannot readily be integrated into the IC. The number and space requirement of electronic components is thus reduced considerably.

Upon integration of the photodiode and the receiver electronic circuitry in an IC, the wires connecting the photodiode to a current/voltage transformation stage become very short. As a result, these wires are less likely to act as antennas, so that the optical smoke detector is less sensitive to interference. Thus, comparable detection reliability can be achieved with a smaller, less expensive photodiode surface, at a lower signal level as compared with current optical smoke detectors.

The micro-Fresnel elements (MFE) and the holographic-optical elements (HOE) permit a larger optical aperture than conventional lenses. Thus, more scattered light is collected, and signals can be raised to a higher detection level, with greater immunity against electrical interference.

Micro-Fresnel elements (MFE) permit designs with two or more foci. In a scattered-light detector of this type, the scattering volume is imaged onto two or more separate radiation receivers which can be provided with crossed polarizers. In the absence of smoke, under the assumption that radiation from the background reaches the photodiodes unpolarized (after several reflections at the trap), both photodiodes receive radiation of the same background. In the case of contamination of the scattered-light smoke detector, the radiation of the background increases but remains unpolarized. Thus, the so-called base or background pulses for each of the photodiodes remain the same even as a scattered-light detector may become increasingly contaminated. Readily, without requiring further optical elements, a scattered-light detector in accordance with a preferred embodiment of the invention is provided with polarization filters.

We claim:

1. An optical smoke detector comprising at least one radiation source (1) and at least one radiation receiver (2) in optical receiving relationship with the radiation source (1) via an optical path, wherein:

the optical path traverses a measurement volume (8) accessible to ambient atmosphere;

the radiation receiver (2) is sensitive to radiation changes caused by smoke particles (12) in the measurement volume (8), for producing a signal to an electronic evaluation circuit as a function of radiation incident on the radiation receiver (2); and at least one planar-optical element (5) is disposed in the optical smoke detector, for optical microstructure of the planar-optical element to interact with light traveling in the optical path from the radiation source (1) to the radiation receiver (2).

2. The optical smoke detector of claim 1, wherein the radiation receiver (2) is sensitive to radiation scattered by the smoke particles (12), and further comprising a radiation trap (3) disposed for minimizing parasitic radiation from reaching the radiation receiver (2).

3. The optical smoke detector of claim 2, wherein the planar-optical element (5) is a holographic optical element (HOE).

4. The optical smoke detector of claim 2, wherein the planar-optical element (5) is a micro-Fresnel reflector (MFR).

5. The optical smoke detector of claim 4, wherein the micro-Fresnel reflector (MFR) comprises a plurality of microsurfaces, disposed such that, for a predetermined wavelength, optical paths between the radiation source (1) and the radiation receiver (2) via different microsurfaces have lengths which differ by an integral multiple of the wavelength.

6. The optical smoke detector of claim 5, wherein the wavelength is at least approximately equal to 880 nm.

7. The optical smoke detector of claim 2, wherein the planar-optical element (5) is a reflective element having a microsurface structure on a side of light incidence.

8. The optical smoke detector of claim 2, wherein the planar-optical element (5) is a reflective element having a microsurface structure on a side opposite to a side of light incidence.

9. The optical smoke detector of claim 2, wherein the optical radiation source (1) and the optical receiver (2) are disposed on a printed-circuit board.

10. The optical smoke detector of claim 9, wherein the planar-optical element (5) is exposed to the radiation source (1).

11. The optical smoke detector of claim 9, wherein the planar-optical element (5) is exposed to the radiation receiver (2).

12. The optical smoke detector of claim 9, comprising at least two planar-optical elements (5), one planar-optical element (5) being exposed to the radiation source (1) and another planar-optical element being exposed to the radiation receiver.

13. The optical smoke detector of claim 2, comprising an auxiliary mirror element (13) disposed for deflecting light not scattered from smoke particles (12) into the radiation trap (3).

14. The optical smoke detector of claim 13, wherein the auxiliary mirror element (13) has a flat mirror surface.

15. The optical smoke detector of claim 13, wherein the auxiliary mirror element (13) has a curved mirror surface.

16. The optical smoke detector of claim 9, wherein the radiation source (1) is an infrared-emitting diode.

17. The optical smoke detector of claim 9, wherein the radiation source (1) is a laser diode.

18. The optical smoke detector of claim 2, further comprising a polarization filter (15) exposed to the radiation receiver (2).

19. The optical smoke detector of claim 18, wherein the polarization filter (15) has a plane of polarization which is perpendicular to a plane of scattering defined by the optical path from the radiation source (1) to the radiation receiver (2).

20. The optical smoke detector of claim 2, comprising at least two different-color radiation sources (1) and at least two spaced-apart radiation receivers (2).

21. The optical smoke detector of claim 2, comprising at least two spaced-apart radiation receivers (21, 22), wherein the planar-optical element (5) comprises two microsurface regions (A, B) having different foci and being disposed for deflecting scattered light from the measurement volume (8) to the two radiation receivers (21, 22), further comprising two polarization filters (14, 15) having different planes of polarization and each (14, 15) being disposed at a respective radiation receiver (22, 21).

22. The optical smoke detector of claim 21, wherein the polarization filters (14, 15) have planes of polarization which are mutually perpendicular.

23. The optical smoke detector of claim 2, comprising at least two different-color radiation sources (1) and at least five spaced-apart radiation receivers (21, 22, 23, 24, 25), wherein the planar-optical element (5) comprises two microsurface regions (A, B) having different foci and a superposed structure, disposed for deflecting scattered light from the measurement volume (8) to the five radiation receivers (21, 22, 23, 24, 25), two pairs (21 and 22, 24 and 25) of the five radiation receivers (21, 22, 23, 24, 25) being provided with polarization filters (14, 15) such that the joint planes of polarization of polarization filters (14) of one pair (21 and 22) of radiation receivers are different from the joint planes of polarization of polarization filters (15) of another pair (24 and 25) of radiation receivers.

24. The optical smoke detector of claim 23, wherein the superposed structure is a grating.

25. The optical smoke detector of claim 23, wherein the joint planes of polarization of polarization filters (14) of the one pair (21 and 22) of radiation receivers are perpendicular to the joint planes of polarization of polarization filters (15) of the other pair (24 and 25) of radiation receivers.

26. The optical smoke detector of claim 2, wherein the planar-optical element (5) is laminated to the radiation trap (3).

27. The optical smoke detector of claim 2, wherein the planar-optical element is embossed on the radiation trap (3).

28. The optical smoke detector of claim 2, further comprising a mirror (27) in the optical path from the radiation source (1) to the radiation receiver (2).

29. The optical smoke detector of claim 28, wherein the mirror (27) is a shallow depression in a plastic housing.

30. The optical smoke detector of claim 1, wherein the radiation receiver (2) is sensitive to extinction of radiation in the measurement volume (8).

* * * * *